US006663013B1

(12) United States Patent
Vanden Heuvel et al.

(10) Patent No.: US 6,663,013 B1
(45) Date of Patent: Dec. 16, 2003

(54) ARC THERMAL SPRAY GUN APPARATUS

(75) Inventors: Tim R. Vanden Heuvel, Appleton, WI (US); David D. Lewisen, Appleton, WI (US); Jeffrey J. Calaway, Appleton, WI (US)

(73) Assignee: Thermach, Inc., Hortonville, WI (US)

( * ) Notice: Subject to any disclaimer, the term of this patent is extended or adjusted under 35 U.S.C. 154(b) by 76 days.

(21) Appl. No.: 09/876,416

(22) Filed: Jun. 7, 2001

(51) Int. Cl.[7] ..... B05B 1/24

(52) U.S. Cl. ..... 239/83; 239/81; 239/84; 239/290; 239/600; 239/1; 219/76.14; 219/76.16

(58) Field of Search ..... 239/1, 8, 79, 81, 239/83, 84, 290, 296, DIG. 4, 600; 219/76.14, 76.16, 121.47, 121.51

(56) References Cited

U.S. PATENT DOCUMENTS

| | | | | | |
|---|---|---|---|---|---|
| 1,930,373 | A | * | 10/1933 | Stubenrauch | 239/84 |
| 4,024,369 | A | | 5/1977 | Thompson et al. | |
| 4,078,097 | A | | 3/1978 | Miller | |
| 4,095,081 | A | | 6/1978 | Ashman | |
| 4,430,546 | A | | 2/1984 | Irons et al. | |
| 4,668,852 | A | * | 5/1987 | Fox et al. | 219/76.14 |
| 5,584,433 | A | * | 12/1996 | Nakagawa | 239/83 |
| 5,897,059 | A | | 4/1999 | Müller | |
| 5,908,670 | A | * | 6/1999 | Dunkerley et al. | 239/83 |
| 5,964,405 | A | | 10/1999 | Benary et al. | |
| 6,005,215 | A | | 12/1999 | Boyd et al. | |
| 6,076,742 | A | | 6/2000 | Benary | |
| 6,091,042 | A | | 7/2000 | Benary | |
| 6,137,078 | A | | 10/2000 | Keller | |

* cited by examiner

*Primary Examiner*—Steven J. Ganey
(74) *Attorney, Agent, or Firm*—Denise L. Stroker; Godfrey & Kahn, S.C.

(57) ABSTRACT

An arc spray gun has a pair of wire guides that guide two metal wires to an arc zone near the wire tips where an electric current through the wires effect an arc, thereby melting the wire tips. The wire guides are of a two-part design. One part is easily removable without the need for tools. Generally, each removable part of the wire guide is temporarily held within a stationary wire guide by an O-ring. A retainer then holds the removable wire guide firmly in place. A gas cap keeps the retainer firmly against the removable wire guides while the gun is in use.

18 Claims, 6 Drawing Sheets

ARC THERMAL SPRAY GUN APPARATUS

FIELD OF THE INVENTION

This invention relates generally to thermal spray apparatus and particularly to a dual wire, arc type of thermal spray gun.

BACKGROUND OF THE INVENTION

Thermal spraying is a process of melting and propelling fine particles of molten material such as metal to form a coating. One type of thermal spray gun is a dual wire, arc thermal spray gun in which two wires are fed into electrical contact at the wire ends. The ends are melted by an electrical arc with current passed through the wires. A jet of compressed gas (usually air) is blown through the arc zone to atomize (i.e. nebulize) the molten metal and effect a spray stream of molten metal particles. Arc current can be of the order of hundreds of amperes. Typically the power is brought through cables connected to feed rollers and/or wire guides in the gun that electrically contact the wires and guide them to the point of arcing.

Wire guides are used to both guide the wire to the arc zone and to transfer electrical energy from the DC power source to the wire. Because they need to be efficient conductors of electricity, they are usually made of copper or copper-base alloys. Due to the friction of the feedstock wire, some of which can be extremely abrasive, wire guides need to be changed on a frequent basis.

Various configurations for jetting the atomizing air to the melting wire tips have been used in efforts to provide an effective spray stream, and for introducing auxiliary air to modify and improve the spray stream, for example as taught in U.S. Pat. No. 5,964,405 (Benary et al.) However, there has remained a need for improvement in the wire guides. In the existing art, the wire guides are screwed into a stationary wire guide that requires a tool in order to replace the guide. On production lines where the spray guns are used, it may take an average of five minutes to change the wire guides in one spray gun. This is true if there are no problems, such as binding between the threaded portion of the wire guide. In an effort to properly align the wire guides, a technician may use a tool to bend the wire guide after it has been screwed into place. This can cause difficulty when the time arrives for replacement of the wire guide. Some companies have several spray guns on line, and may need to shut down production for a significant amount of time between each guide change-over. Accordingly, a need exists for an improved spray gun having wire guides that can be changed relatively quickly.

SUMMARY OF THE INVENTION

The present invention relates to an improved, dual wire, arc thermal spray gun that allows the user to change the wire guides without the need for any tools. The wire guides may be removed and replaced by hand without screwing them into place. An arc thermal spray apparatus of the present invention generally includes a spray gun body housing, a pair of wire guides that can receive wire, and a gas cap or nozzle attached to the body adjacent the wire guides. The wire guides are positioned so that their ends converge to guide the two metal wires to a point of contact at their spraying tips. A gas tube is positioned in the gun body on an axis located centrally with respect to the stationary wire guides, and is used to channel gas such as air to the spraying tips. A retainer is attached to the gun body coaxially with the central axis to hold the removable wire guides in place. The gas cap is attached to the gun body coaxially with the central axis to serve as a nozzle and to hold the retainer in position with respect to the removable wire guides.

The removable wire guides can be removed from the stationary wire guides without the use of a tool. The user can quickly change the removable wire guides by simply removing the gas cap and retainer, and pulling the removable wire guides from the stationary wire guides housed by the gun body. A fresh pair of removable wire guides are pushed into the stationary wire guides so that they are temporarily frictionally retained by the O-rings seated within the stationary wire guides, and the retainer slides over the guides and gas cap is reattached to the gun body. The relatively quick ability to change wire guides results in significant time savings. Further, the retainer ensures optimal alignment of the removable wire guides.

While the present invention is particularly useful in dual wire arc thermal spray guns, other applications are possible and references to use with dual wires should not be deemed to limit the application of the present invention. The present invention may be advantageously adapted for use where similar performance capabilities and characteristics are desired. These and other objects and advantages of the present invention will become apparent from the detailed description, claims, and accompanying drawings.

DESCRIPTION OF THE PREFERRED EMBODIMENTS

Figure 1:
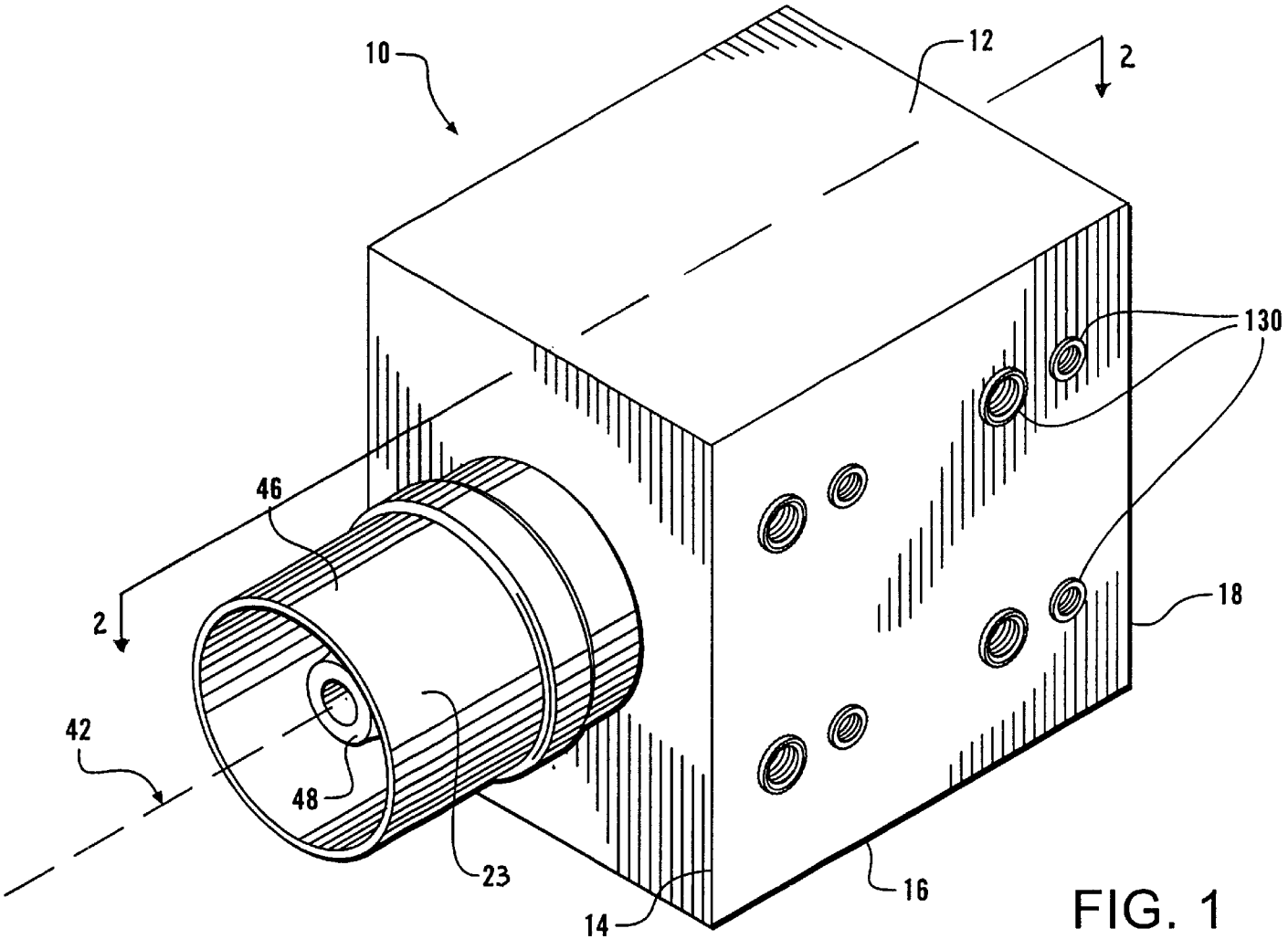
FIG. 1 is a front perspective view of an arc spray apparatus of the present invention.
Figure 2:
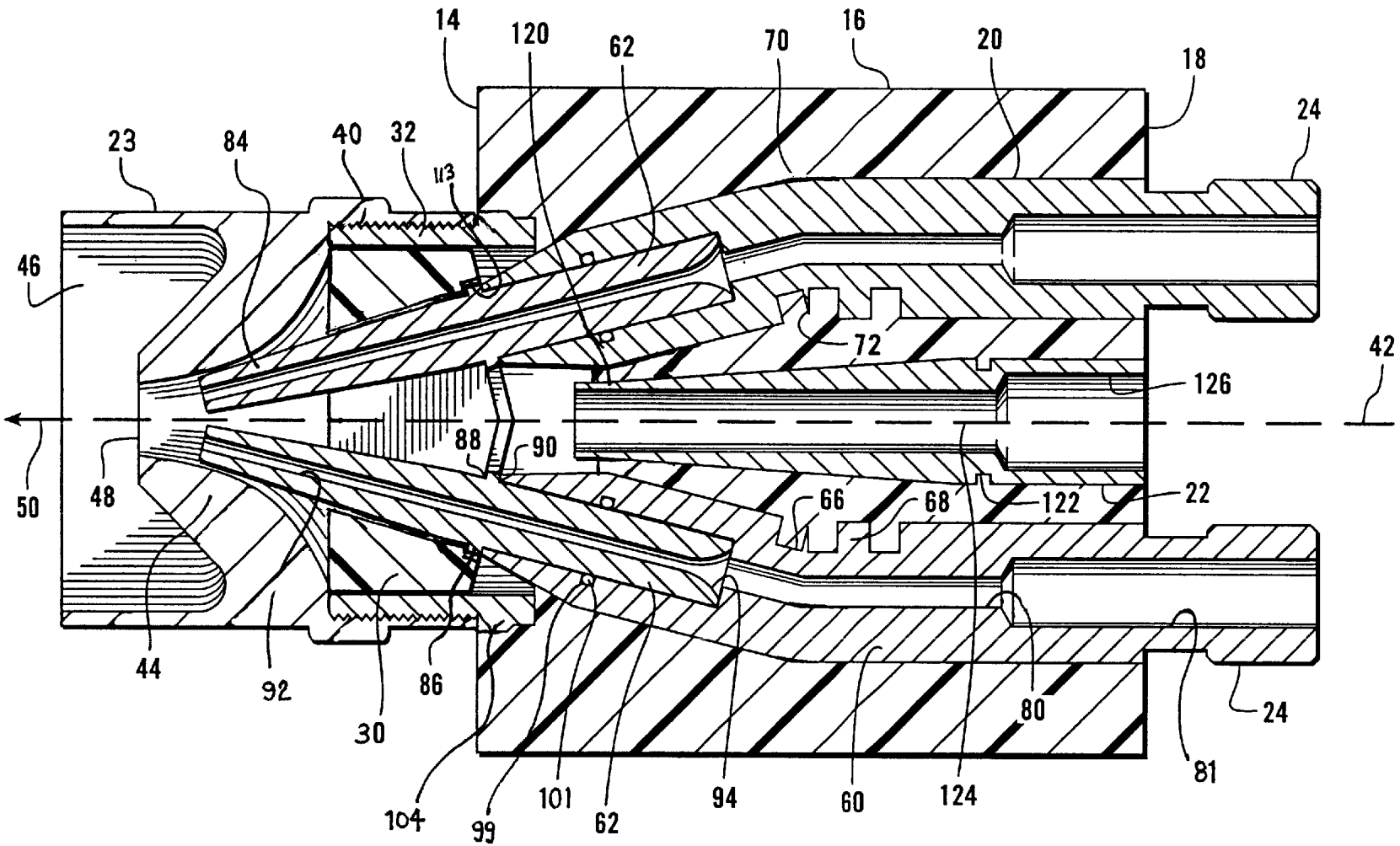
FIG. 2 is cross-sectional view of the apparatus shown in FIG. 1, taken along line 2—2 of FIG. 1.

A dual wire, arc thermal spray gun 10 (FIGS. 1–6) incorporating the invention may be a conventional type except with respect to the wire guides described herein. In the present example, a gun body 12 has three general portions, namely a forward portion 14, a middle portion 16 and a rear portion 18 (FIG. 1). As best seen in FIG. 2, the middle portion 16 contains the wire guides 20 and a gas tube 22. From the forward portion 14 projects a nozzle or gas cap 23, and from the rear portion 18 projects the rear portion 24 of the wire guides 20. A retainer 30 is positioned on the wire guides 20 in the middle portion 16.

(As used herein, the terms "forward" and "front" are with reference to the direction in which the wires are driven, and "rear" and "rearward" denote the opposite direction. The terms "inner" and "inward" mean facing or directed toward the axis.)

The rear portion 18 can be connected to a conventional wire drive mechanism (not shown). The type of wire drive is not important to this invention, and any suitable conventional or other desired mechanism may be used. A wire drive may be used to replace or supplement the push drive in the gun.

In the present example, electrical contact is made through the wire guides 20 to the wires (not shown). Electrical connections to the wire guides 20 can be made by a typical screw/nut connection to a pair of electrically conductive coaxial cables (also not shown) which extend from a power source to the rear of the gun at rear portion 24. The type of electrical contact to the wires is not important to the present invention, and any other conventional or desired contact means such as compressive joints may be used.

Figure 3:
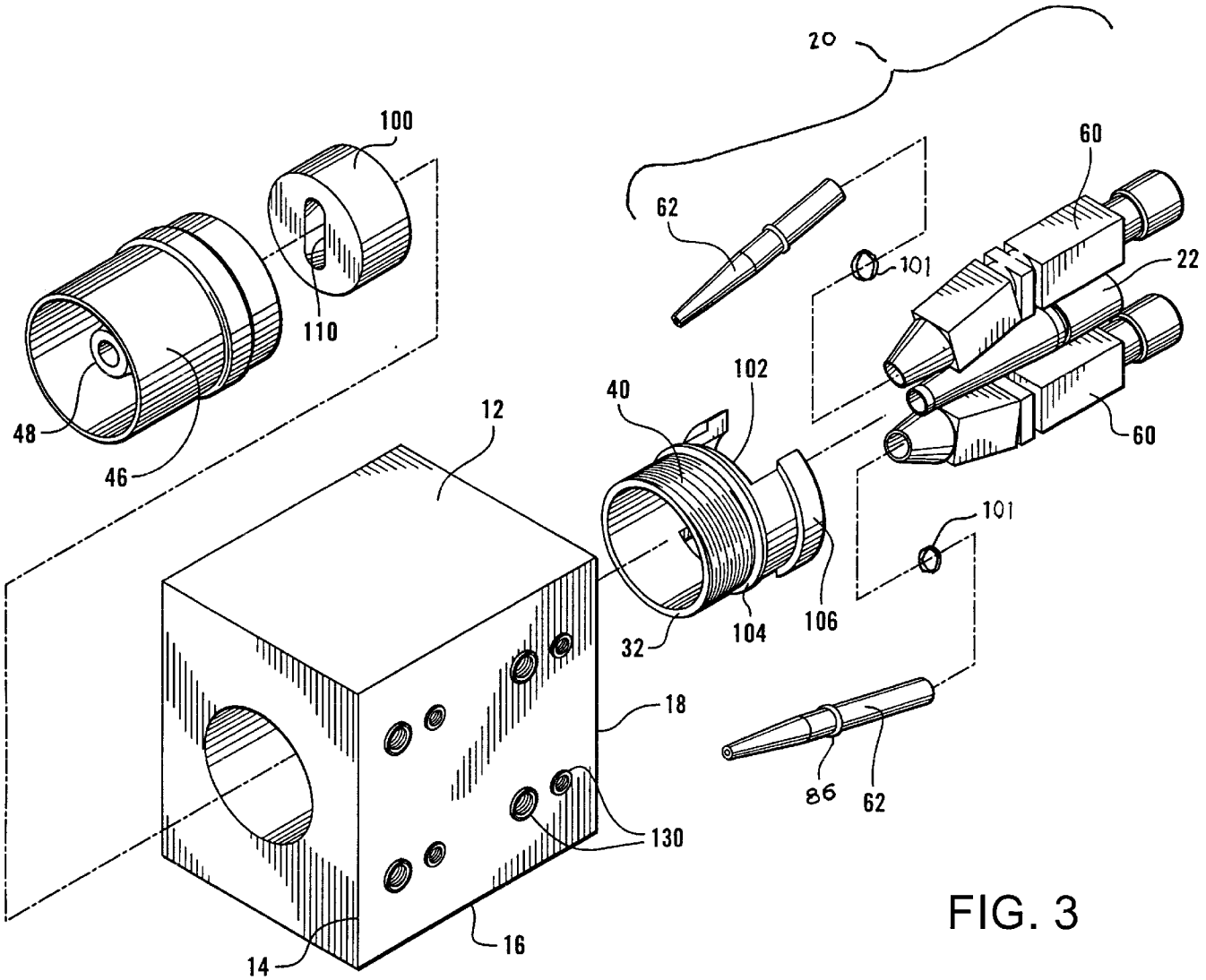
FIG. 3 is an exploded view of the apparatus shown in FIG. 1.

Referring to FIGS. 2 and 3, the gas cap 23 is held to the forward gun body by a threaded portion 40 located on the exposed section of adapter 32, at the front portion 14 of the gun body. The gas cap 23 is positioned coaxially with a central axis 42 located centrally between the wire guides 20. The gas cap 23 in the present embodiment has a radius section 44, rearward of a tubular section 46. Radius section 44 can generally be described as a conicalshape with a decreasing interior radius. The radius section 44 narrows forwardly to a constricted aperture 48 to form a nozzle directing the atomizing air flow from the gas tube 22 to the wire tips (not shown). Atomizing air or other gas from a source of compressed gas is brought through hoses or the like and into the gas tube 22 at the rear portion 18 of body 12. This gas cap 23 is known in the art, and can be replaced by other suitable gas caps.

The wire guides 20 converge in a forward direction so that the tips of the metal wires feeding therethrough will approach each other at a point forward of the guides, just inside the aperture 48. With a conventional source of arc power (typically DC) applied through the wires, just before they contact each other an electric arc will be formed, thus melting the wire ends. From the internal radius section 44 of gas cap 23, issues a jet of air axially through the molten wire tips to atomize and propel a spray stream of molten metal particles (designated schematically by an arrow 50) to a substrate for deposition.

Each wire guide 20 has a two-piece construction, generally, a stationary wire guide 60 that is slidably connectable to a removable wire guide 62. Stationary wire guides 60 are fixed within the body 12, whereas the removable wire guides 62 can be selectively attached to stationary wire guides 60.

Figure 7:
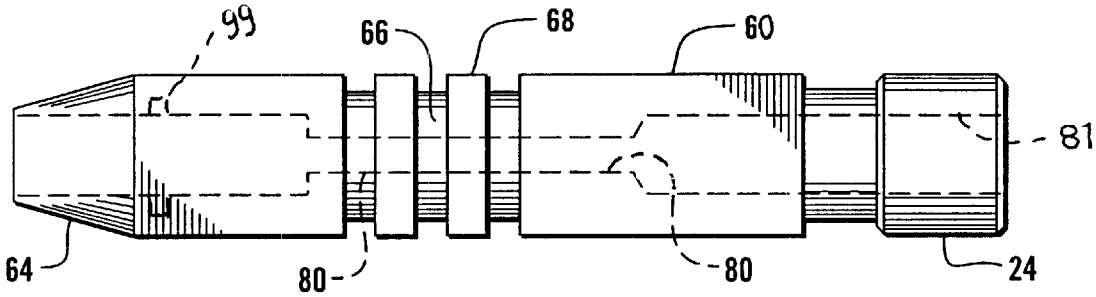
FIG. 7 is a side elevational view of an embodiment of the stationary wire guide of the present invention, prior to bending.
Figure 8:
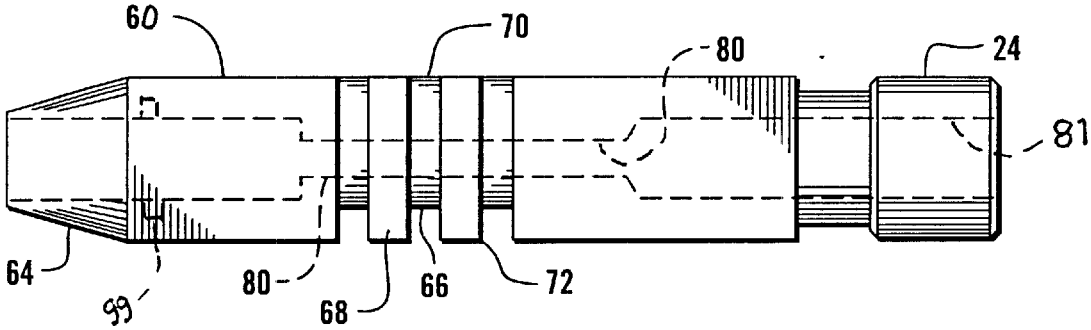
FIG. 8 is a top plan view of the stationary wire guide of FIG. 7.
Figure 9:
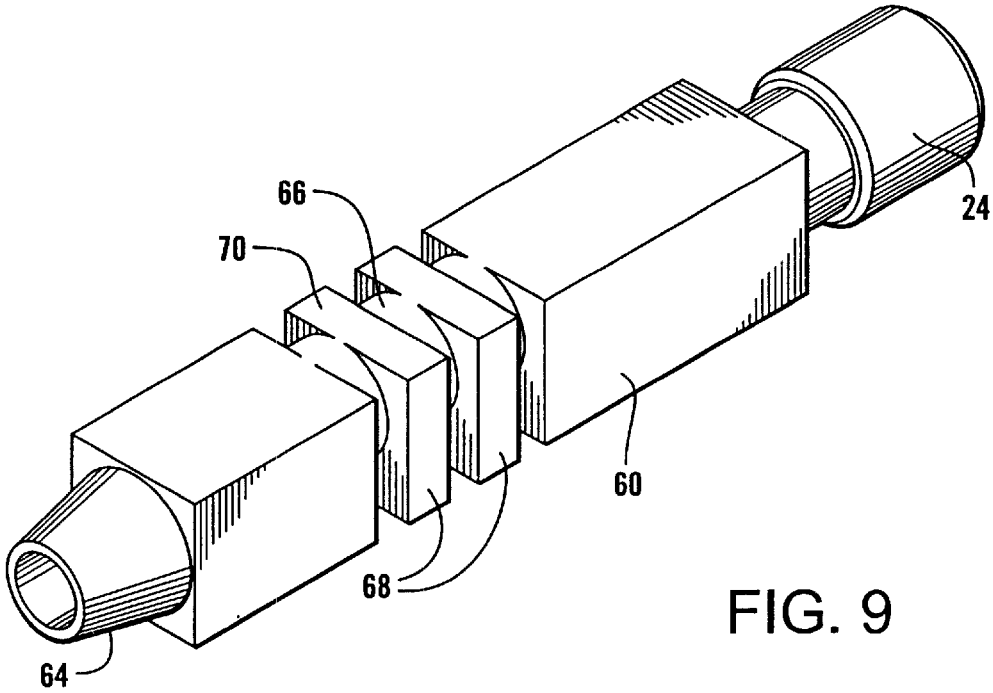
FIG. 9 is a front perspective view of the stationary wire guide of FIG. 7.

The specific construction of the stationary wire guide 60 is as follows. As seen in FIGS. 7 through 9, the guide 60 can be machined on a lathe from a round metal stock or square metal stock (as shown), preferably, of copper or copper alloy. The exterior surface of guide 60 has three primary features. At the rear portion 24 there is preferably an inner or outer thread for connection to a wire source. At the opposite end of the guide 60 is preferably a tapered nose 64. The purpose of the tapered nose 64 is to aid in alignment as the guides 60 are set into the molded body 12. This feature is optional, as there may be other ways to aid in such alignment. Somewhere in the middle section of guide 60 is a series of partial necks 66 between collars 68 that are formed on a lathe, or the like. Preferably, there are three necks 66 and two collars 68. The purpose of the necks 66 is to relieve stress at the middle section so that it can be more easily bent and to prevent adverse deformation such as cracking in the tensile area 70 of the outer skin, or crumpling the compressive inner area 72 of the outer skin.

An inner bore 80 runs through the length of stationary guide 60. The purpose of inner bore 80 is to guide the wire (not shown) from a feed mechanism (also not shown), and to accommodate the removable wire guide 62. Therefore, the bore 80 preferably has at least two distinct diameters. At the tapered nose 64 the bore is preferably of a diameter that allows the removable wire guide 62 to maintain a steady position during gun operation, yet allow the user to remove the removable wire guide 62 from the guide 60 without the use of any tools. In at least the middle portion of the guide 60, the bore is of a diameter that can accommodate wire as it slides through the guides. Near the rear portion, the guide 60 can be counter-bored to a larger diameter bore 81 to accommodate a friction-reducing coaxial cable-liner. It is preferable to offset the necked portion 66 with respect to the longitudinal axis of inner bore 80 to help prevent cracking of the outer skin when guide 60 is bent.

The specific construction of the removable wire guide 62 is as follows. As seen in FIGS. 2 and 3, guide 62 can be constructed from tubular metal stock, such as copper or copper alloy. As seen in FIG. 2, at a forward end 84, removable guide 62 is preferably tapered so that the guides two 62 can converge more closely together when assembled into stationary guides 60. Near a center portion of guide 62 is an outwardly extending collar or shoulder 86, which has a forward side 88 and a rear side 90. The forward side 88 of the shoulder provides a surface upon which a retainer 30 (described herein) bears, once gun 10 is assembled. When assembled, the rear side 90 of the shoulder bears against the forward end of stationary guide 60 so that there is adequate electrical contact between the guides 60 and 62. There is an inner bore 92 of substantially uniform diameter through the length of guide 62. A preferable exception to this uniformity is a tapered counter-bore or radius 94 located at the rear end of bore 92. The purpose of radius 94 is to prevent wire from getting caught at the junction between the stationary and removable guides. Therefore, it is most preferable that the radius is smooth.

As seen in FIGS. 2 and 3, the adapter 32 is made of a generally tubular material, and preferably of aluminum or the like. The purpose of adapter 32 is to provide a means of attachment to the gun body 12. As mentioned previously, the forward end of adapter 32 is preferably threaded on its exterior (or interior) surface so that the air cap can be threadedly attached thereto. In one embodiment, the rear portion of adapter 32, two notches 102 are symmetrically positioned along the adapter 32 diameter to accommodate the stationary wire guides 60. A collar 104 may be used to aid in the assembly of the gun 10, which involves a molding process. The collar 104 is generally flush with respect to the front surface of gun body 12. In addition, as seen in FIG. 3, there is preferably a shoulder 106 at the rear end of adapter 32 for the purpose of anchoring adapter 32 into the molded gun body 12. Other means of attaching the gas cap 23 to gun body 12 may be used. For example, a snap-on attachment may be utilized.

Figure 4:
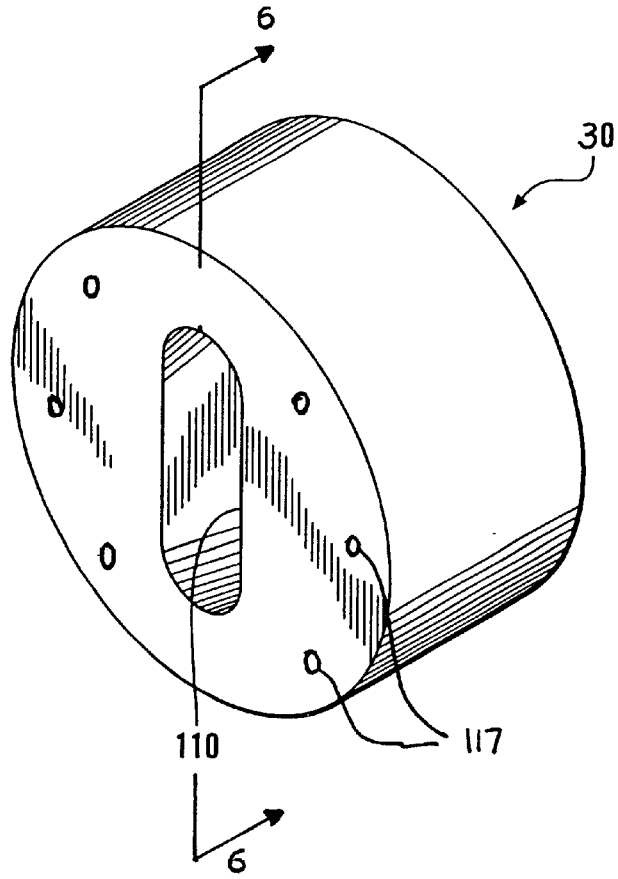
FIG. 4 is a front perspective view of a portion of the retainer as seen in FIGS. 2 and 3.
Figure 5:
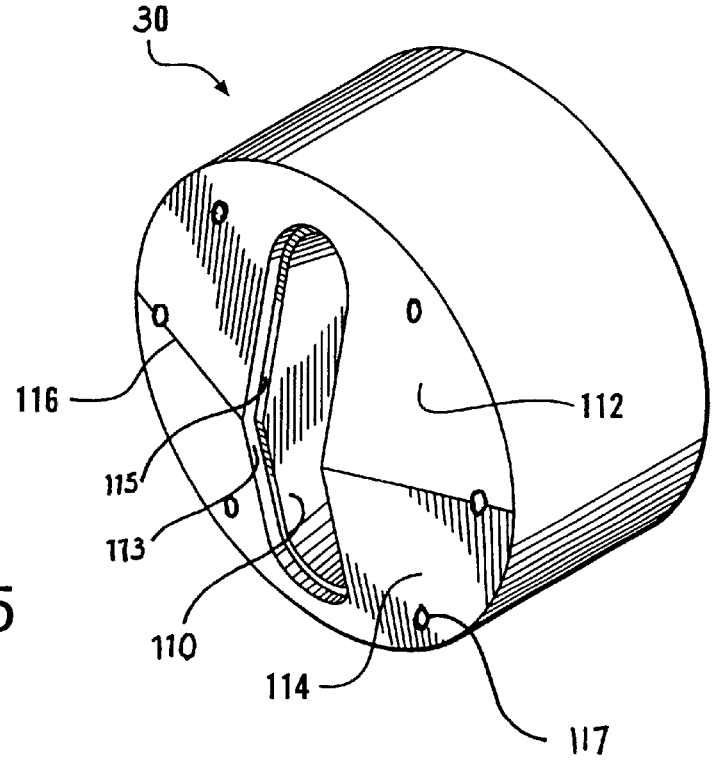
FIG. 5 is a rear perspective view of the retainer shown in FIG. 4.
Figure 6:
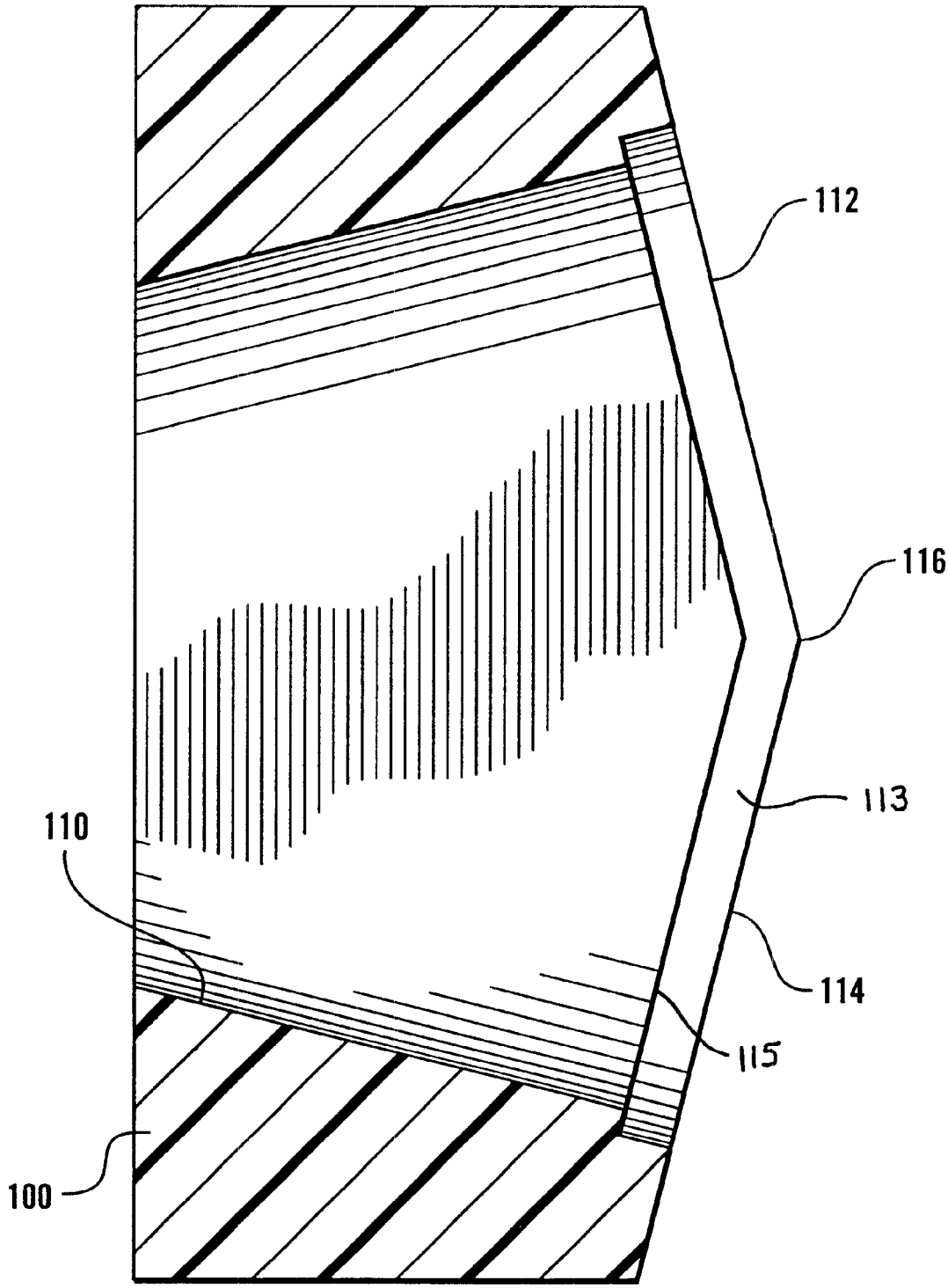
FIG. 6 is a side cross-sectional view of the retainer shown in FIGS. 4 and 5, taken along line 6—6 in FIG. 4.

The retainer 30 is preferably molded or machined from a non-conductive, heat-resistant material such as a high performance plastic. As seen in FIGS. 4 through 6, retainer 30 is generally a cylindrical-shaped member with a slot 110 extending therethrough. Slot 110 accommodates and properly positions removable guides 62 by being longer at the rear than at the front. The forward end of retainer 30 preferably has a substantially flat forward face with slot 110 having a relatively short opening therein. Also, preferably, the angle of the slot is somewhat less divergent than the outside taper of the properly aligned guides 62 so that the there is some clearance between the guides 62 and retainer 30 except at shoulders 86. Specifically, the rear surface of retainer 30 is a "peaked surface" resulting from two converging planes 112 and 114, wherein the peak 116 is laterally positioned with respect to the relatively large opening of slot 110. Inside the slot 110 at the peaked surface is an inner rim 115. The inner rim 115 bears against shoulder 86 on the removable guide 62. Preferably, on each end of slot 110, the surface 113 surrounding rim 115 fits against shoulder 86 with a clearance fit. The peaked surface and the inner rim are at substantially the same angle as removable wire guide shoulders 86 so the retainer can put a substantially uniform pressure thereon. As can be seen in FIG. 2, such pressure keeps the guides 62 in place and properly aligned during use of the gun 10.

Optionally, retainer 30 may include one or more air channels 117 running from the peaked surface to the opposite flat face. Preferably, there are about six equally spaced air channels 117 as seen in FIGS. 4 and 5. The purpose of the air channel 117 is to provide a decrease in air pressure at the arc zone to prevent distortion of the electric arc. However, this may also be achieved by reducing the gas or air pressure fed through the gun 10, or by using more or less air channels 117.

Referring again to FIGS. 2 and 3, gas tube 22 is generally a tubular member that has a taper at the forward end 120 so as not to interfere with the converging ends of the stationary wire guides 60, and has a necked portion 122 so it cannot be pulled out of the gun body 12. Further, the tube 22 preferably has a hexagonal profile, or some other profile that can resist torque so that it does not become dislodged from gun body 12. An inner bore 124 extends through the length of gas tube 22. Preferably, a threaded chamfered counter-bore 126 extends inwardly from the rear portion 18 of the gun body 12 for attachment to an air or gas source (not shown). It will be appreciated that the body 12 could contain a bore rather than a gas tube 22.

Preferably, the apparatus 10 is generally formed by setting the stationary components such as the adapter 32, gas tube 22, and stationary guides 60 in a non-conductive epoxy or resin material. Threaded sleeves 130 (as seen in FIG. 1) may be embedded in the side of the mold for the attachment of a handle or robotic arm. After the molding process is complete, O-rings 101 are seated into the grooves 99 within guides 60. Removable guides 62 are placed into the stationary guides 60 so that shoulder 86 butts against the tapered nose of guide 60. The O-rings 101 temporarily hold the guides 62 in position. Retainer 30 is then placed onto the removable guides 62 so that it is seated against the forward side 88 of shoulder 86. Gas cap 23 is attached to adapter 32 to hold the retainer 30 firmly against guides 62, to provide stability, alignment and electrical contact.

In operation, the changing of the removable wire guides 62 is conveniently simple and expeditious. First, the gas cap 23 and retainer 30 are removed. Next the removable wire guides 62 are replaced with a fresh pair. The gas cap 23 and retainer 30 are reattached. It is not necessary to use tools for this procedure.

Other styles for the atomizing gas cap 23 may be used. For example a nozzle orifice may be used in place of the tapering section of air cap. Alternatively, two or more gas jets may be utilized, preferably axisymetrically or concentrically, for example concentric passages. However, it is advantageous to incorporate the tapering section into the gas cap 23, for simplicity and effective atomization.

Although the invention has been herein shown and described in what is perceived to be the most practical and preferred embodiments, it is to be understood that the invention is not intended to be limited to the specific embodiments set forth above. Accordingly, it is recognized that modifications may be made by one skilled in the art of the invention without departing from the spirit or intent of the invention and therefore, the invention is to be taken as including all reasonable equivalents to the subject matter of the appended claims.

We claim:

1. An arc thermal spray apparatus comprising:

a spray gun body;

a pair of removable wire guides;

a pair of stationary wire guides located within the gun body and adapted for receiving a pair of wires, the stationary wire guides having convergent ends for receiving the pair of removable wire guides that guide the two metal wires to an arc zone;

a gas tube located in the gun body between the stationary wire guides;

a retainer attached to the gun body to hold the removable wire guides in place; and a gas cap attached to the gun body coaxially with the central axis, to serve as a nozzle and to hold the retainer against the removable wire guides;

wherein the pair of removable wire guides are non-threaded so that they can slidingly engage the stationary wire guides.

2. The arc thermal spray apparatus of claim 1 further including an O-ring seated within the stationary wire guides for retaining the removable wire guide.

3. The arc thermal spray apparatus of claim 2 wherein the removable wire guides are tubular, each with an outer surface that slidingly engages the O-rings for selective removal.

4. The arc thermal spray apparatus of claim 1 wherein the removable wire guides each further include a shoulder upon which the retainer is seated against when the gas cap is attached to the gun body.

5. The arc thermal spray apparatus of claim 1 wherein the retainer has a slot and at least one air channel therein to reduce air pressure at the slot when the apparatus is in use.

6. The arc thermal spray apparatus of claim 1 wherein the retainer has a rear peaked surface resulting from two converging planes, and an opposite forward surface.

7. The arc thermal spray apparatus of claim 6 wherein the retainer slot is longer at the rear peaked surface than at the forward surface.

8. The arc thermal spray apparatus of claim 7 wherein the retainer has a rim located inside the slot at the rear peaked surface, wherein the rim bears against the shoulders on each removable wire guide.

9. An arc thermal spray apparatus comprising:

a spray gun body;

a pair of removable wire guides;

a pair of stationary wire guides located within the gun body and adapted for receiving a pair of wires, the stationary wire guides having convergent ends for receiving the pair of removable wire guides that guide the two metal wires to an arc zone;

an O-ring seated inside each stationary wire guide for temporarily retaining the removable wire guides;

a gas tube located in the gun body between the stationary wire guides;

a retainer having a slot therethrough, the retainer attached to the gun body coaxially with the central axis to hold the removable wire guides in place; and an adapter attached to the gun body, the adapter extending partially therefrom, wherein a gas cap is attached to the gun body at the adapter to serve as a nozzle and to hold the retainer against the removable wire guides.

10. The arc thermal spray apparatus of claim 9 wherein the retainer has a slot and at least one air channel therein to reduce air pressure at the slot when the apparatus is in use.

11. The arc thermal spray apparatus of claim 9 wherein the retainer has a rear peaked surface resulting from two converging planes, and an opposite forward surface.

12. The arc thermal spray apparatus of claim 11 wherein the retainer slot is longer at the rear peaked surface than at the forward surface.

13. The arc thermal spray apparatus of claim 12 wherein the retainer has a rim located inside the slot at the rear peaked surface, wherein the rim can bear against the shoulders on each removable wire guide.

14. The arc thermal spray apparatus of claim 9 wherein the adapter has two notches symmetrically positioned on one end of the adapter.

15. Wire guides for an arc thermal spray apparatus, the apparatus including a spray gun body to hold the wire guides convergingly so as to guide two metal wires to a position where an electrical arc can be formed, a gas tube in the gun body, the wires being receptive of an arc current to effect the arc and create molten metal, and the gas tube being receptive of a source of compressed gas to issue a gas flow for atomization of the molten metal and production of a spray stream thereof through a gas cap, wherein the wire guides each comprise:

a stationary wire guide having a wire receptor end opposite a guide receptor end; and a non-threaded removable wire guide that slidingly engages the stationary wire guide at the guide receptor end.

16. Wire guides for an arc thermal spray apparatus, the apparatus including a spray gun body to hold the wire guides convergingly so as to guide two metal wires to a position where an electrical arc can be formed, a gas tube in the gun body, the wires being receptive of an arc current to effect the arc and create molten metal, and the gas tube being receptive of a source of compressed gas to issue a gas flow for atomization of the molten metal and production of a spray stream thereof through a gas cap, wherein the wire guides each comprise:

a stationary wire guide having a wire receptor end opposite a guide receptor end; and a removable wire guide that slidingly engages the stationary wire guide at the guide receptor end;

wherein each stationary wire guide has an O-ring seated therein for retaining the removable wire guides.

17. Wire guides for an arc thermal spray apparatus, the apparatus including a spray gun body to hold the wire guides convergingly so as to guide two metal wires to a position where an electrical arc can be formed, a gas tube in the gun body, the wires being receptive of an arc current to effect the arc and create molten metal, and the gas tube being receptive of a source of compressed gas to issue a gas flow for atomization of the molten metal and production of a spray stream thereof through a gas cap, wherein the wire guides each comprise:

a stationary wire guide having a wire receptor end opposite a guide receptor end; and a removable wire guide that slidingly engages the stationary wire guide at the guide receptor end;

wherein each stationary wire guide has an O-ring seated therein for retaining the removable wire guides, and each removable wire guide has a shoulder adapted for contact with a retainer that will retain the removable wire guides in the gun body when the gas cap is connected thereto.

18. A method of installing wire guides in an arc thermal spray gun comprising:

seating an O-ring into each of several stationary wire guides located in the spray gun body;

slidably inserting a removable wire guide into each stationary wire guide so that the removable wire guide is retained by the O-ring;

placing a retainer over the removable wire guides;

attaching a gas cap over the retainer to hold the retainer in contact with the removable wire guides.

* * * * *